US007882843B2

(12) United States Patent
Jones

(10) Patent No.: US 7,882,843 B2
(45) Date of Patent: Feb. 8, 2011

(54) SMOKING ARTICLE COMPONENT TRANSFER DEVICE AND METHOD

(75) Inventor: Donald Horace Jones, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 250 days.

(21) Appl. No.: 11/830,135

(22) Filed: Jul. 30, 2007

(65) Prior Publication Data

US 2008/0073253 A1 Mar. 27, 2008

Related U.S. Application Data

(60) Provisional application No. 60/847,167, filed on Sep. 26, 2006.

(51) Int. Cl.
*A24C 1/18* (2006.01)
*A24C 1/20* (2006.01)
*A24C 5/06* (2006.01)

(52) U.S. Cl. ..... 131/77; 131/94; 131/907; 131/108; 131/282; 131/283

(58) Field of Classification Search ..... None
See application file for complete search history.

(56) References Cited

U.S. PATENT DOCUMENTS 2,538,698 A * 1/1951 McNeill ..... 414/26
2,902,186 A 9/1959 Pollmann
3,067,644 A 12/1962 Dearsley
3,372,790 A 3/1968 Pembroke et al.
4,489,736 A * 12/1984 Bolt ..... 131/282
4,708,237 A 11/1987 Buisson et al.
4,886,077 A 12/1989 Hinzmann et al.

FOREIGN PATENT DOCUMENTS

| | | |
|---|---|---|
| DE | 940699 | 3/1956 |
| EP | 1388298 | 2/2004 |
| GB | 641141 | 8/1950 |
| GB | 666079 | 2/1952 |
| WO | WO-2006/087188 | 8/2006 |

OTHER PUBLICATIONS

XP002481360, Beitz, W. Dr.-Ing., Prof.: "Dubbel Taschenbuch für den Maschinenbau", Springer Verlag, Berlin Heidelberg, New York, 180095, 1987.

* cited by examiner

*Primary Examiner*—Richard Crispino
*Assistant Examiner*—Phu H Nguyen
(74) *Attorney, Agent, or Firm*—Connolly Bove Lodge & Hutz LLP

(57) ABSTRACT

Described herein is a method and apparatus for transferring rods, or tubes, comprising feeding a plurality of rods into a hopper, feeding the rods through a hopper using agitation and gravity to align the rods in a single-file stacked configuration, and transferring the rods with pushers on a continuous cable so that that the rods may be transferred for insertion in the tobacco column. This method and apparatus may utilize one or more drums for transferring rods from the hopper to the pushers on the continuous cable.

6 Claims, 4 Drawing Sheets

SMOKING ARTICLE COMPONENT TRANSFER DEVICE AND METHOD

CROSS REFERENCE TO RELATED APPLICATION

The present application claims the benefit of provisional application Ser. No. 60/847,167, filed Sep. 26, 2006, for all useful purposes, and the specification and drawings thereof are included herein by reference.

FIELD OF THE INVENTION

The present invention relates to a device and method of transferring components, such as rods or tubes, for use in smoking article manufacturing.

BACKGROUND OF THE INVENTION

Drum transfer systems are known in the tobacco industry on cigarette tipping and packaging machinery. However, many drum supply methods are speed limited to such an extent that they cannot feed components fast enough to meet the minimum speed for forming a consistent tobacco rod. Thus, a need exists for a faster rod transfer device and method to permit the formation of a consistent tobacco rod.

SUMMARY OF THE INVENTION

Described herein is a method for transferring rods, or tubes, comprising feeding a plurality of rods into a hopper, feeding the rods through a hopper using agitation and gravity to align the rods in a single-file stacked configuration, and transferring the rods with pushers on a continuous cable so that that the rods may be transferred for insertion in the tobacco column. This method may utilize one or more drums for transferring rods from the hopper to the pushers on the continuous cable.

Also described is an apparatus for transferring rods comprising a hopper for feeding a plurality of rods to a transfer point, said hopper capable of feeding the rods through hopper using agitation and gravity to align the rods in a stacked single-file configuration, and a cable/chain with intermittently spaced pushers for engaging the rods so that that the rods may be transferred for insertion in the tobacco column. This device may comprise one or more drums for transferring rods from the hopper to the pushers on the continuous cable.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF PREFERRED EMBODIMENTS

Embodiments of the present invention will now be described with reference to the drawings. Generally speaking, rods or tubes for smoking articles are provided to a hopper. The terms "rod" and "tube" are used herein interchangeably. Both terms refer to generally to hollow and solid structures for use in smoking article manufacture. The rods may be double length rods such as the type used in the so called 2-up configuration for smoking article manufacture. The rods are fed continuously so that they may be engaged with a pusher for moving the rods in a serially aligned direction.

Figure 1:
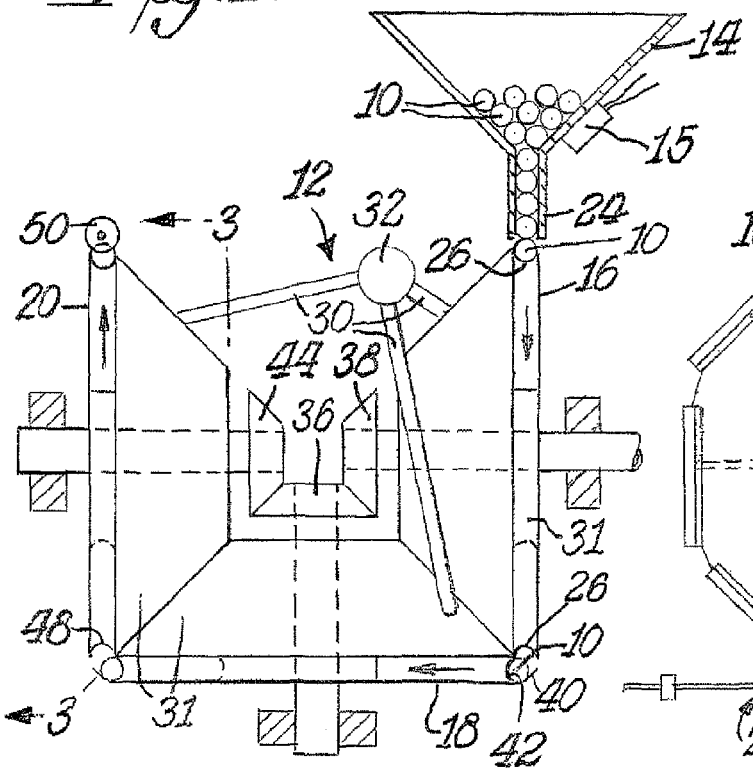
FIG. 1 is a side elevational view showing a first embodiment for insertion of a rod into a tobacco feed mechanism using synchronized drums.

According to a first embodiment, shown in FIG. 1, rods 10 are aligned using apparatus 12, which includes a hopper 14, first wheel 16, second wheel 18, third wheel 20, and pick-up mechanism 22. Initially, rods 10 are provided to hopper 14 that may comprise an agitation mechanism 15. The rods 10 are aligned in an alignment chamber 24 in a single row stacked configuration using agitation and gravity to ensure continuous flow.

Figure 2:
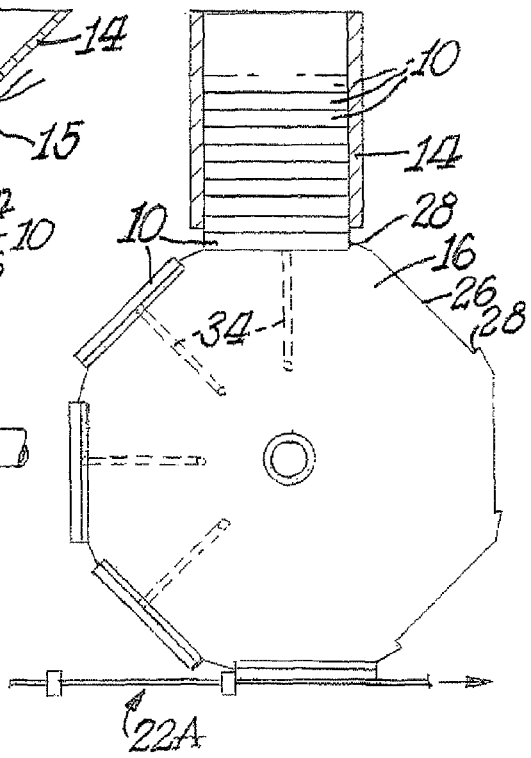
FIG. 2 is a right side elevational view of the wheel 16 shown in FIG. 1 having the pick-up mechanism 22A being under wheel 16.
Figure 3:
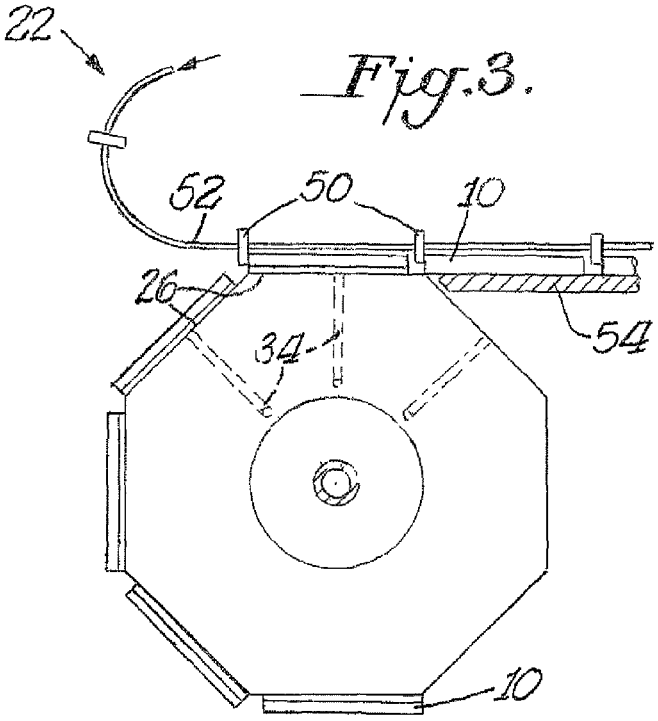
FIG. 3 is a side elevational view in cross-section taken along line 3-3 in FIG. 1.
Figure 4:
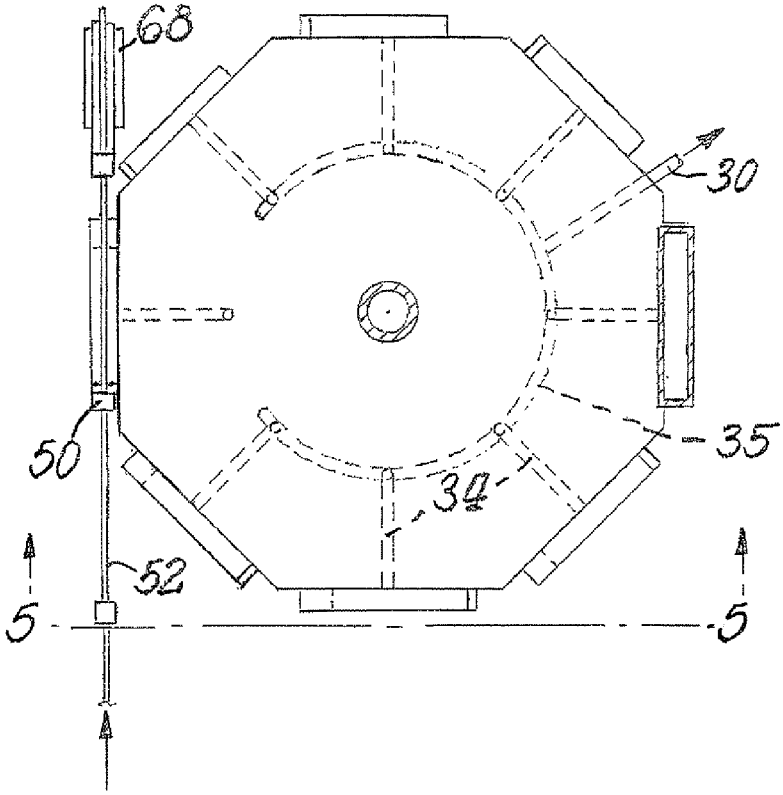
FIG. 4 is a top plan view of a second embodiment for insertion of a rod into a tobacco feed mechanism using a single drum to transfer rods from a hopper to cable-driven pushers.

As each rod 10 reaches the bottommost portion of the hopper 14, it is engaged with a flute 26 on first rotating drum 16. Rotating drum 16 has a raised surface 28, shown in FIG. 2, to strip the rod 10 from the hopper 14 and ensure repeatable and accurate positioning within flute 26. Pick up and retention is assisted and ensured by way of internal drum vacuum provided via vacuum plenum 32 connected via vacuum lines 30 to ports 34 that extend radially and then axially from the surface of flutes 26 as shown in phantom in an alternative embodiment shown in FIG. 2. The vacuum is distributed using generally conical shaped vacuum distribution mechanisms 31, which are well known in the art. Similar ports 34 to those shown in FIG. 2 are shown in FIGS. 3 and 4. Some details of the vacuum system are omitted for simplicity, but are well known to those skilled in the art of drum vacuum application.

As rod 10 rotates around drum 16 it may be transferred to drum 18, as shown in FIG. 1, or to a pusher mechanism 22*a*, as shown in FIG. 2. First drum 16 may rotate in a counterclockwise direction when viewed from the right side in elevation to deliver rod 10 to drum 18 or pusher mechanism 22*a*. It should be understood that drums 16 and 18 and pusher mechanism 22*a* could rotate in the direction opposite that described and shown so long as drum 16 and drum 18, or drum 16 and pusher mechanism 22*a*, travel synchronously at the time of transfer. It should also be noted that wheel 16 for the first embodiment shown in FIG. 1 may be configured identically to the alternate first embodiment shown in FIG. 2. For both embodiments, stationary guides or holding fingers, not shown, may also be used if the mass of rod 10 is too great to control by vacuum alone.

According to the first embodiment, shown in FIG. 1, second drum 18 may be synchronized with the first drum 16 by a driven bevel gear 36, which may be driven by motor M and may have teeth, not shown, for engaging and driving bevel gears 38 and 44. Bevel gears 38 and 44 may be attached to and rotate wheels 16 and 20, respectively. Second drum 18 may have a guide means 40 for transferring rod 10 from drum 16 to drum 18. As rod 10 tangentially aligns with drum 18, the vacuum in flute 26 is reduced or disengaged. Rod 10 may then be guided into contact with drum 18 through the force of gravity and the sideward guidance of guide mechanism 40. Alternatively or additionally, a vacuum may be engaged such that rod 10 is drawn toward flute 42 of drum 18. Because drum 18 is synchronized with drum 16, drum 18 rotates counter-clockwise when viewed from the top of apparatus 12 and carries rod 10 to a tangentially aligned position with third drum 20. Drum 18 may have an alignment mechanism for positioning rod 10 within flute 42 if required for given tube/rod mass and surface characteristics. This mechanism, which is not shown for the sake of simplicity, may consist of a raised surface such as the raised surface 28 on first drum 16, shown in FIG. 2.

Third drum 20 is synchronized with drum 18 by virtue of gear 44 being engaged with gear 36, as discussed above. Third drum 20 may pick up rod 10 from flute 42 of drum 18 through a centrally controlled vacuum that is provided at the surface of flutes 48 via radially and axially extending ports 34, shown in phantom in FIG. 3. When viewed along line 3-3 of FIG. 1, as shown in FIG. 3, drum 20 rotates in a clockwise direction, but may move in any direction dictated by its synchronization with drums 16 and 18. Drum 20 may have an alignment mechanism for positioning rod 10 within flute 48 if required for given tube/rod mass and surface characteristics. This mechanism, which is not shown for the sake of simplicity, may consist of a raised surface such as the raised surface 28 on first drum 16, shown in FIG. 2.

After being received by third drum 20, the rods can be removed using a pusher 50 that is attached to a cable, belt, or chain 52, as shown in FIG. 3. Pusher 50 may bye round, square, or any suitable shape for pushing rod 10. Cable 52 may be driven by a driving mechanism, which is not shown for purposes of simplicity but is well known in the art of cable, belt, and chain driving. Cable 52 is synchronized so that it moves at a matched speed with flute 48. This allows cable 52 to guide rod 10 onto substrate 54 without damaging rod 10 during transfer. Once on substrate 54, rod 10 may be incorporated in the further creation of a smoking article.

Alternatively, as shown in FIG. 2, pusher mechanism 22*a* may be placed below drum 16 to transfer rod 10 to the later stages of smoking article manufacture. According to this embodiment, cable 22*a* may engage rod 10 directly from first wheel 16.

Figure 6:
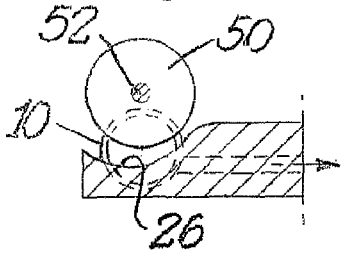
FIG. 6 is a cross-sectional view in elevation showing a tube or rod being engaged by a pusher attached to a drive chain or cable.
Figure 5:
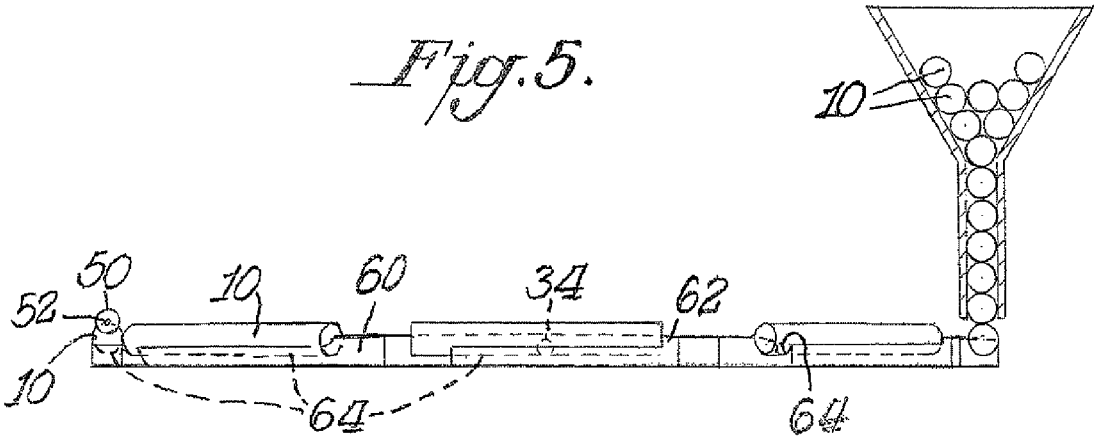
FIG. 5 is an enlarged side elevational view of FIG. 4 looking in the direction of line 5-5 shown in FIG. 4.

According to a second embodiment, shown in FIGS. 4 through 6, rods 10 may be fed from hopper 14 in the manner described above, i.e. using gravity and agitation. As shown in FIGS. 4 and 5, rods 10 are deposited on flutes 64 of a horizontally rotating drum 60. Flutes 64 may have a raised surface 62 to ensure repeatable and accurate positioning of rod 10. Pick up and retention may be assisted and ensured by way of an internal vacuum provided to flutes 64 through ports 34 which may be connected to a vacuum manifold 35 and a vacuum line 30. Additionally or alternatively, guides or holding fingers, not shown, may also be used if the mass of rod 10 is too great to control by vacuum alone.

As drum 60 rotates, rod 10 is aligned with pushers 50 on a cable 52 in a manner similar to that described with reference to FIGS. 1 through 3. Raised surface 62 on the drum flute 64 is designed to generally mate with pushers 50 on the cable, chain, or belt 52, as shown in FIG. 6. Pushers 50 engage the top portion of rods 10 to push rods 10 onto substrate 68, as shown in FIG. 4, for further processing of rod 10 as a component of a smoking article. The speeds of drum 60 and cable 52 are synchronized to prevent damage to the rod 10 during transfer. Flutes 64 on drums 60 are designed for smooth tangential transfer of rods 10 and to accommodate the length and diameter of the rod 10.

Figure 7:
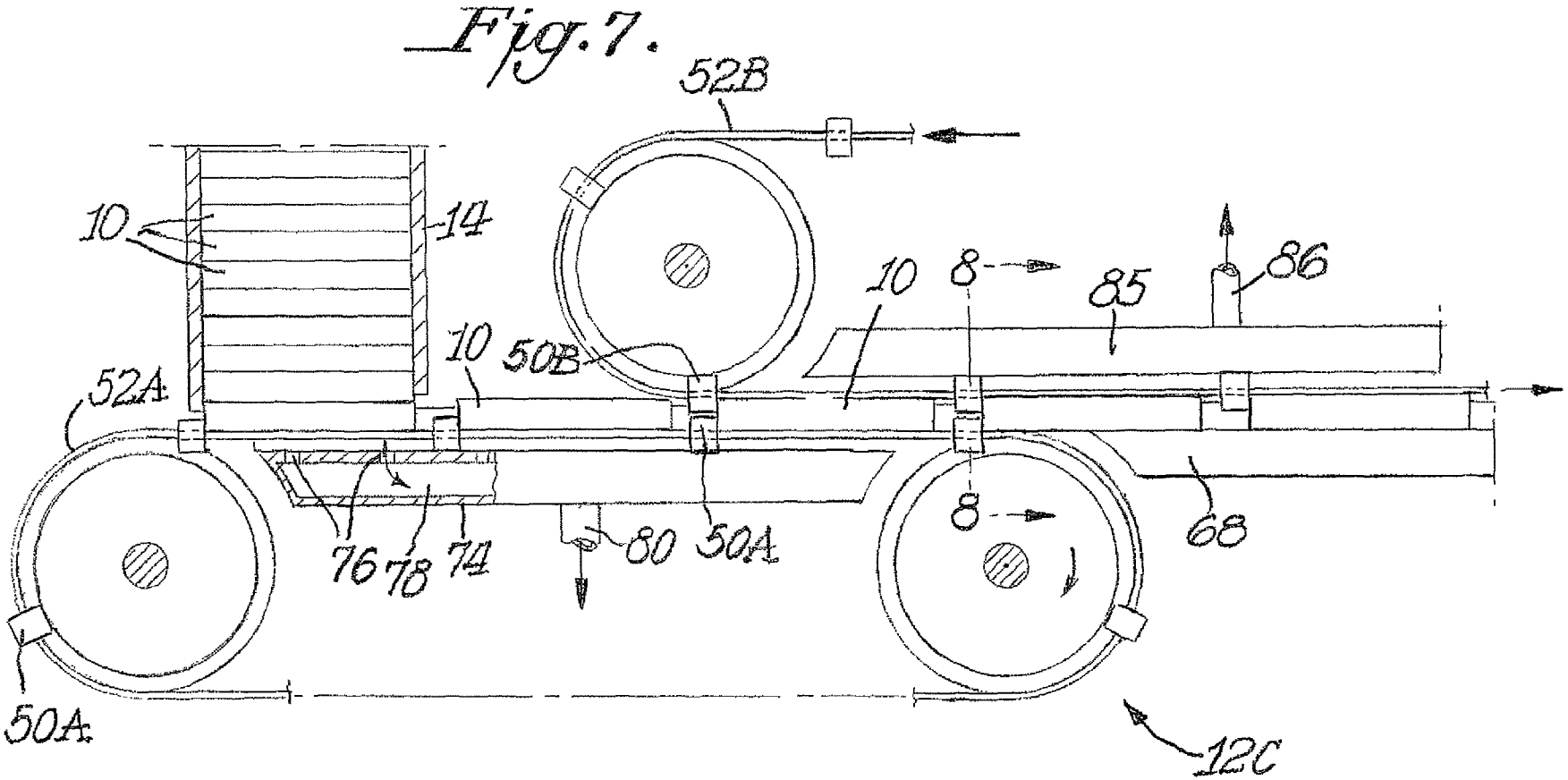
FIG. 7 is a schematic side elevational view partially in cross-section of a third embodiment for insertion of tubes or rods into a tobacco feed mechanism using two coordinated pushers on parallel horizontal cables.
Figure 8:
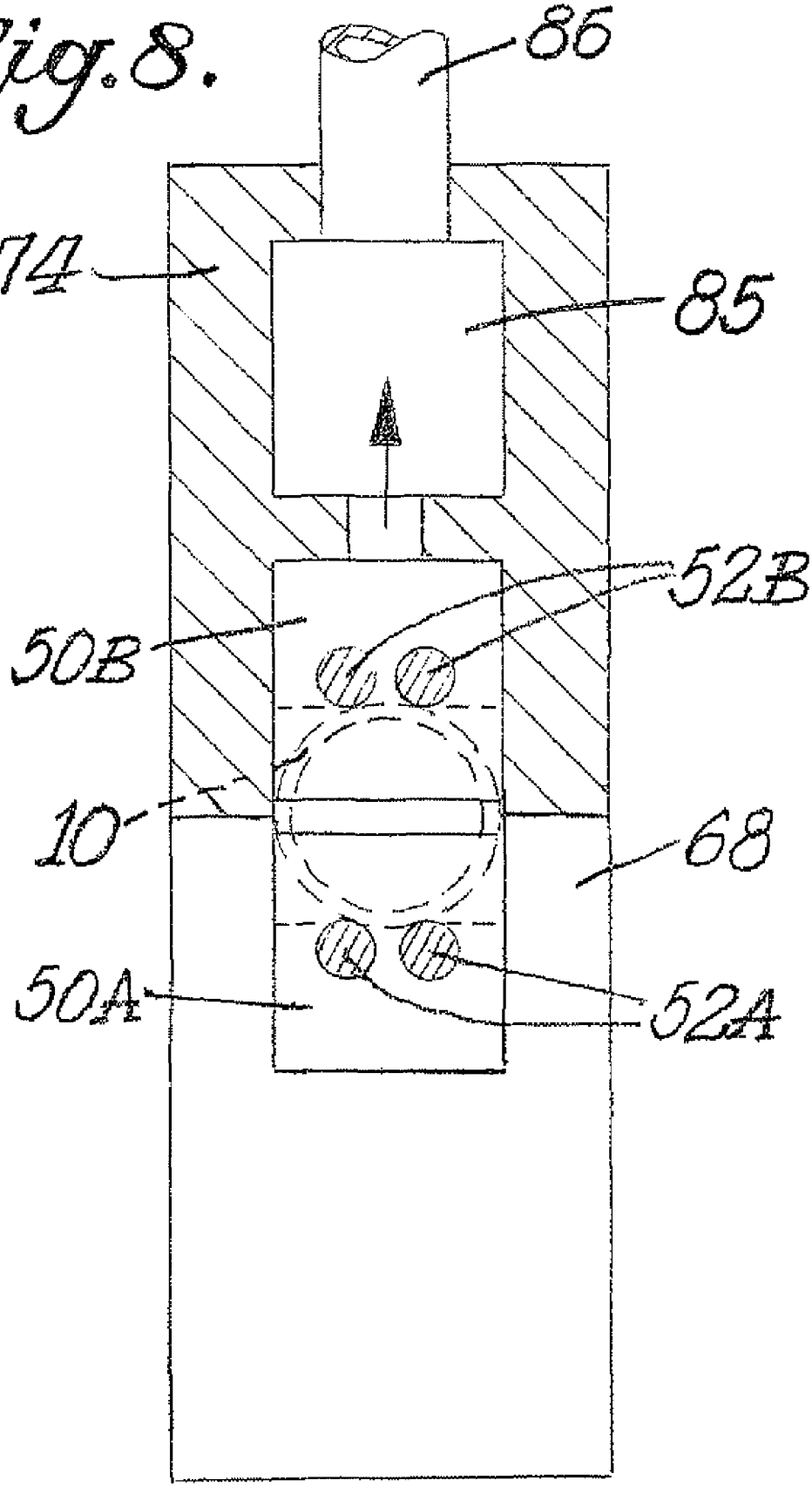
FIG. 8 is a cross-sectional view in elevation taken along line 8-8 of FIG. 7.

A third embodiment is shown in FIG. 7. Rods 10 may be fed from a hopper 14, as previously described above. However, upon reaching the bottom of hopper 14, rods 10 are received on belt 52A with pushers 50A in a trough 74 that is located below hopper 14. Belt 52A may comprise a flat belt, a chain, or one or more cables as shown in FIG. 8. In fact, using two cables may assist in maintaining orientation of the pushers 50A. As rods 10 drop in single file fashion, each rod 10 falls within the space between adjacent pushers 50A. Belt 52A moves in a direction to advance rods 10 through trough 74 by engaging pushers 50A with one end of rod 10 and urging the rod 10 forward. Accurate pick up and transfer are assisted by a vacuum provided, for example, at ports 76 which are interconnected by chamber 78 within trough 74. Chamber 78 is connected to the vacuum source through vacuum line 80.

As rods 10 advance, they are engaged from above by another belt 52B with pushers 50B. Belt 52B may comprise a flat belt, a chain, or one or more cables as shown in FIG. 8. Using two cables may assist in maintaining orientation of the pushers 50B. Belts 50A and 50B may travel at a matched speed so that pushers 52A and 52B remain aligned and so that rods 10 do not appreciably change position relative to one another. Pushers 50B engage the top portion of rods 10 and push rods 10 onto substrate 68, as shown in FIG. 7, for further processing of rod 10 as a component of a smoking article. A vacuum may be provided to upper trough 85 through a chamber and ports, not shown, using a configuration similar to that of chamber 78, discussed above.

FIG. 8 shows a cross-sectional view taken along line 8-8 in FIG. 7, but omits the wheel in order to highlight the fact that substrate 68 and trough 85 may be abutted to enhance the quality and efficiency of the vacuum.

It should be understood that the above detailed description while indicating preferred embodiments of the invention are given by way of illustration only since various changes and modifications within the spirit and scope of the invention will become apparent to those skilled in the art from the detailed description. For example, for purposes of describing the invention, a cable is shown and described for the pusher mechanism in the various embodiments. However, it should be recognized that the cable could be replaced with a belt or chain without diverting form the invention.

What is claimed is:

1. A method for transferring rods comprising:

feeding a plurality of rods into a hopper;

each rod having a longitudinal axis;

feeding the rods through the hopper using agitation and gravity to align the rods one above the other in a single-file stacked configuration, with the longitudinal axes parallel to one another;

transferring the rods to a plurality of flutes on a first drum rotating about an axis transverse to the longitudinal axes of the aligned rods by engaging one end of the rod at the bottom of the hopper with a raised surface of each flute to strip the rod from the hopper;

applying a vacuum to the rods to retain the rods within the flutes of the drum;

transferring the rods from the first drum to a plurality of flutes on a second drum rotating about an axis transverse to the longitudinal axes of the aligned rods by removing the vacuum from the first drum and applying a vacuum to flutes in the second drum;

transferring the rods from the second rotating drum to a plurality of flutes on a third drum rotating about an axis transverse to the longitudinal axes of the aligned rods by removing the vacuum from the second rotating drum and applying a vacuum to flutes in the third rotating drum; and removing the rods from the third rotating drum by removing the vacuum from the third drum and engaging the rods with pushers on a continuous cable so that the rods may be transferred for insertion in a tobacco column.

2. The method of claim 1 wherein first, second and third drums are linked by gears to ensure a constant speed of rotation between the three drums and wherein the first, second, and third drums are rotated at an approximately identical speed to the speed of the cable.

3. A method for transferring rods comprising:

feeding a plurality of rods into a hopper;

each rod having a longitudinal axis;

feeding the rods through the hopper using agitation and gravity to align the rods one above the other in a single-file stacked configuration, with the longitudinal axes parallel to one another;

transferring the rods to a plurality of flutes on a drum rotating about an axis transverse to the longitudinal axes of the aligned rods by engaging one end of the rod at the bottom of the hopper with a raised surface of each flute to strip the rod from the hopper; and removing the rods from the rotating drum by removing the vacuum from the drum and engaging the rods with pushers on a moving cable to transfer the rods from the drum to a position for insertion in a tobacco column.

4. The method of claim 3, wherein the rotating drum has a vertical axis and is rotated about the vertical axis in a horizontal plane.

5. The method of claim 3, wherein the rotating drum has a horizontal axis and is rotated about the horizontal axis in a vertical plane.

6. The method of claim 3, wherein the speed at which the rotating drum is rotated is approximately identical to the speed of the cable.

* * * * *